US008299383B2

(12) United States Patent
Yang et al.

(10) Patent No.: US 8,299,383 B2
(45) Date of Patent: Oct. 30, 2012

(54) PUSH SWITCH

(75) Inventors: Xin Yang, Shenzhen (CN); Wei Wu, Shenzhen (CN)

(73) Assignees: Fu Tai Hua Industry (Shenzhen) Co., Ltd., ShenZhen, Guangdong Province (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 331 days.

(21) Appl. No.: 12/862,720

(22) Filed: Aug. 24, 2010

(65) Prior Publication Data

US 2011/0240449 A1 Oct. 6, 2011

(30) Foreign Application Priority Data

Mar. 30, 2010 (CN) ..... 2010 1 0136535

(51) Int. Cl.
*H01H 13/58* (2006.01)

(52) U.S. Cl. ..... 200/526

(58) Field of Classification Search ..... 200/526, 200/527–528

See application file for complete search history.

(56) References Cited

U.S. PATENT DOCUMENTS 4,194,104 A * 3/1980 Stenta ..... 200/526
4,755,641 A * 7/1988 Lutzenberger et al. ..... 200/526
4,871,885 A * 10/1989 Kamada ..... 200/5 R
5,746,309 A * 5/1998 Neyer ..... 200/528

* cited by examiner

*Primary Examiner* — Xuong Chung Trans
(74) *Attorney, Agent, or Firm* — Altis Law Group, Inc.

(57) ABSTRACT

A push switch includes a housing, a button slidably connected to the housing including a protrusion protruding therefrom, a first elastic member, and a securing member. The securing member includes a rotating block rotatably connected to the housing defining a recess and a second elastic member. The protrusion drives the rotating block to rotate when the button is pushed. After the external force has ceased, the button and the rotating block move back by the rebounding force of elastic members, respectively. The button stays in the predetermined position when the protrusion is retained in the recess. The protrusion disengages from the rotating block when the button is driven again. After the external force has ceased, the rotating block moves to an initial state by the rebounding force of the second elastic member. The button moves to its initial state by the rebounding force of the first elastic member.

8 Claims, 7 Drawing Sheets

PUSH SWITCH

BACKGROUND

1. Technical Field

The present disclosure relates to switches and, particularly, to a push switch.

2. Description of Related Art

There are known various types of push switches used in the operating portion of various sorts of electronic devices. Although conventional push switches satisfy basic requirements, a push switch, which when the actuator is depressed, will be locked in a secondary position, and when the actuator is depressed again, will returns to its initial position where it holds the switch in its initial state, is still required.

BRIEF DESCRIPTION OF THE DRAWINGS

The components in the drawings are not necessarily drawn to scale, the emphasis instead being placed upon clearly illustrating the principles of a push switch. Moreover, in the drawings, like reference numerals designate corresponding parts throughout the several views.

DETAILED DESCRIPTION

Figure 1:
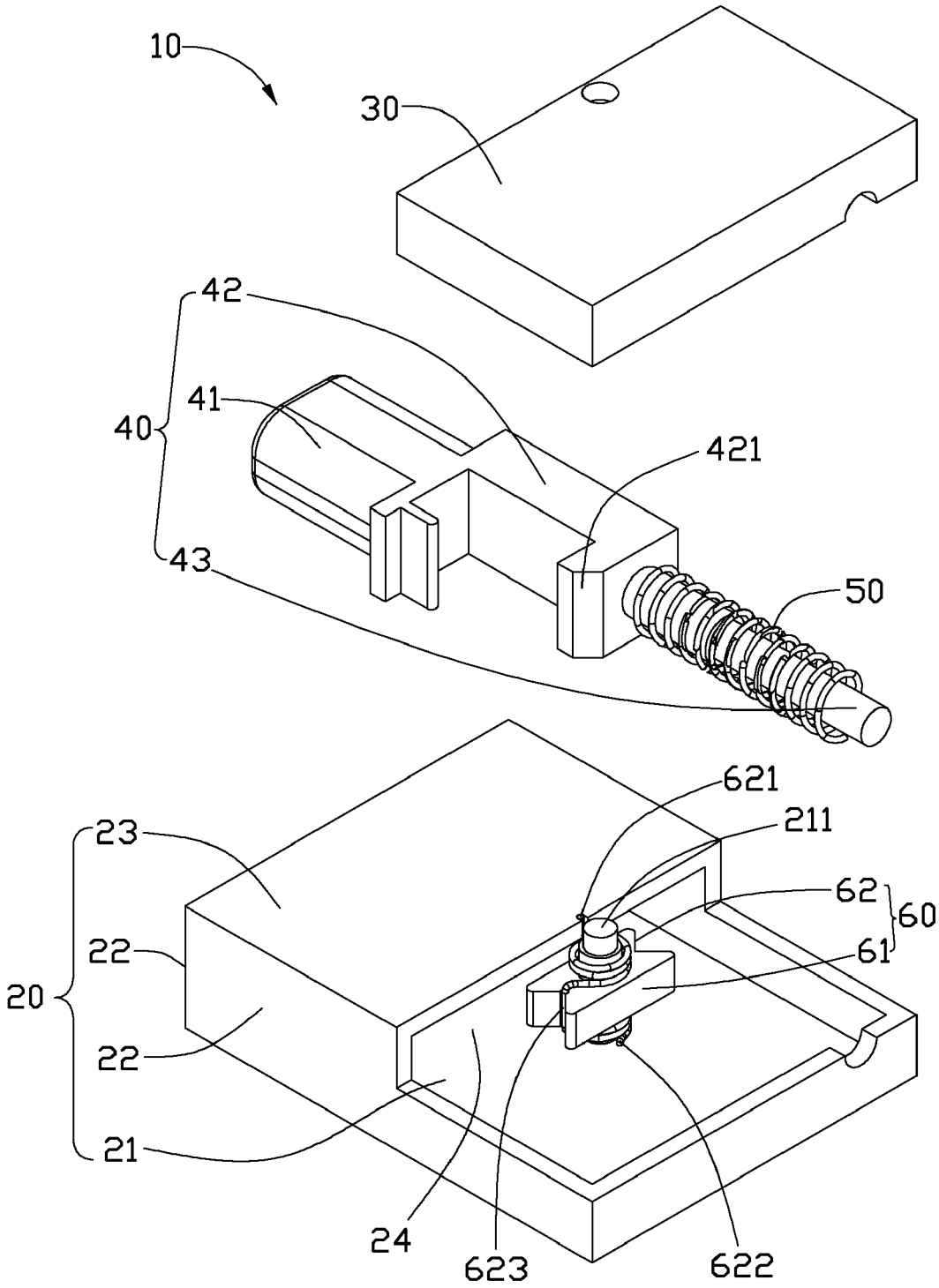
FIG. 1 is a schematic exploded view of a push switch in accordance with an exemplary embodiment.
Figure 2:
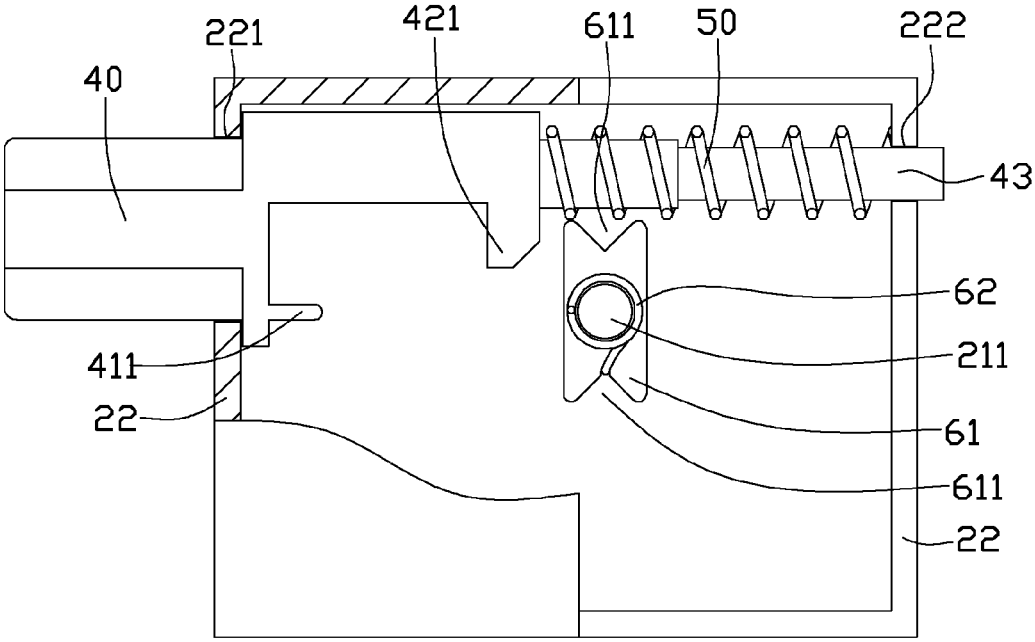
FIG. 2 is a schematic, cutaway view of the push switch of FIG. 1, showing an initial state of the push switch.

Referring to FIGS. 1-2, a push switch 10 in accordance with an exemplary embodiment is provided. The push switch 10 includes a housing 20, a cover 30, a button 40, a first elastic member 50, and a securing member 60. The button 40 is slidably connected to the housing 20. The button 40 can slide relative to the housing 20 when pushed by an external force.

The housing 20 includes a bottom 21, sidewalls 22, and a top 23. The top 23 perpendicularly extends from the sidewalls 22. A length of the top 23 is less than that of the bottom 21 and partly covers the bottom 21. The rest of the bottom 21 is stepped down to accommodate the cover 30. The cover 30 and the housing 20 define a receiving space 24. Part of the button 40 is received in the receiving space 24. The opposite sidewalls 22 extending along a length of the housing 20 defines two opposite through holes 221, 222.

The button 40 includes a pushing member 41, a connecting member 42, and a guiding member 43. A spring tab 411 protrudes from one end of the pushing member 41 and extends towards inside the housing 20. The connecting member 42 extends from the end of the pushing member 41. A protrusion 421 protrudes from a side surface of the connecting member 42. The guiding member 43 extends from an end of the connecting member 42, away from the pushing member 41. The guiding member 43 is substantially perpendicular to the protrusion 421. The pushing member 41 extends through the through hole 221 and is external to the housing 20. The guiding member 43 extends through the through hole 222.

The first elastic member 50 is in a semi-compressed state to maintain rebound force on the button 40 and is further compressed when the button 40 moves inward. The first elastic member 50 provides a rebounding force to bring the button 40 to the initial state whether the button 40 is being turned on or off. In the embodiment, the first elastic member 50 is a coil spring. The spring is arranged around the guiding member 43 and abutting the connecting member 42 and the sidewall 22.

The securing member 60 is configured to secure the button 40 in a predetermined position. The securing member 60 includes a rotating block 61 and a second elastic member 62. In the embodiment, the second elastic member 62 may be a torsion spring. The rotating block 61 defines a recess 611 in each end. The rotating block 61 is rotatably arranged around a post 211 protruding from the bottom 21. One end of the second elastic member 62 is fixed to the top 23, the other end of the second elastic member 62 is fixed to the bottom 21, and the second elastic member 62 is connected to the rotating block 61. The rotating block 61 is thus limited by the second elastic member 62 and stays in an initial position when the rotating block 61 is substantially perpendicular to the moving direction of the button 40 and the right of the protrusion 421 of the connecting member 42.

Figure 3:
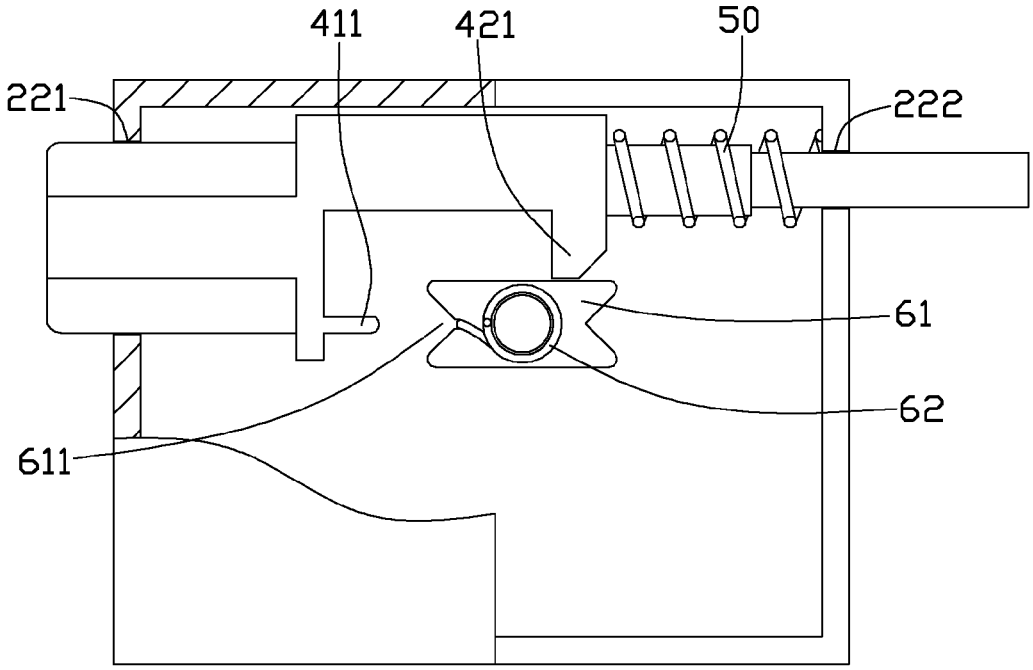
FIG. 3 is similar to FIG. 2, showing a state of the push switch when a button is depressed.
Figure 4:
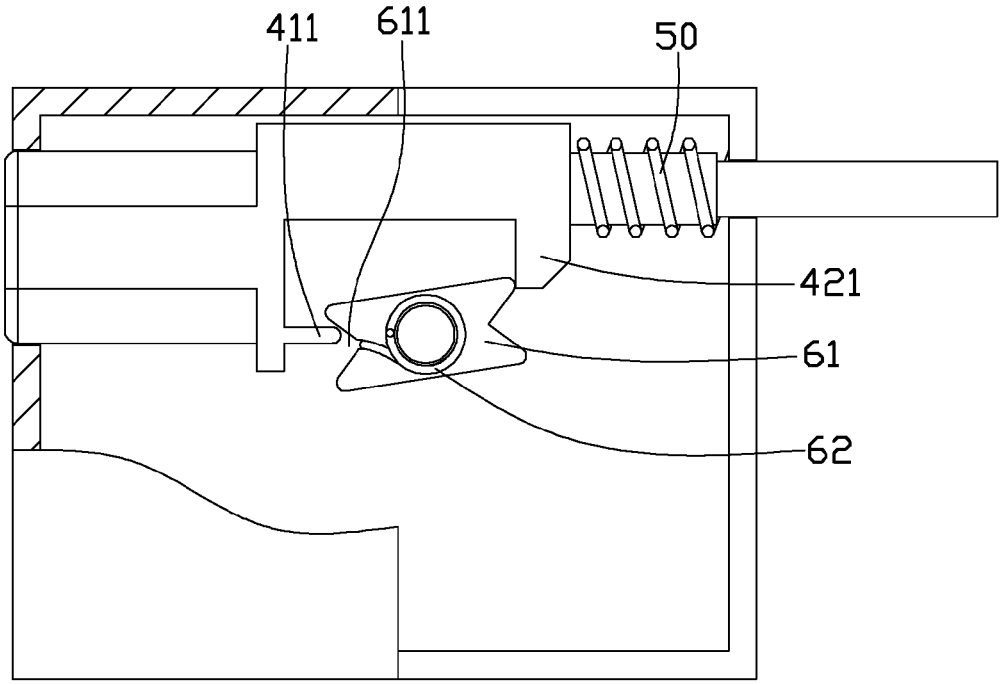
FIG. 4 is similar to FIG. 2, showing a state of the push switch that a spring tab resists a rotating block.
Figure 5:
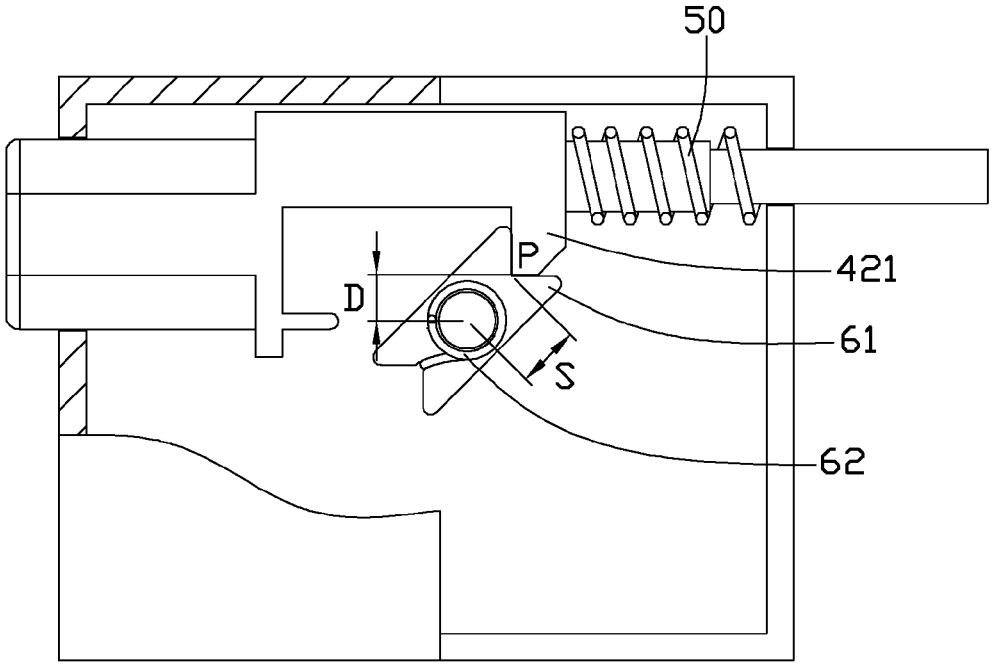
FIG. 5 is similar to FIG. 2, showing a state of the push switch that a protrusion of the button is received in a recess of the rotating block.

Referring to FIGS. 3-5, when the button 40 slides relative to the housing 20 by the external driving force of the pushing member 41, the protrusion 421 of the connecting member 42 pushes the rotating block 61 to rotate, and contracts the second elastic member 62. When the end of the protrusion 421 is in contact with a sidewall of the rotating block 61, the rotating block 61 is caused to be parallel to the moving direction of the button 40. The rotating block 61 starts to rotate back to the initial position by the rebounding force of the second elastic member 62 when the protrusion 421 disengages from the sidewall of the rotating block 61. The rotating block 61 stops rotating when contacting the spring tab 411 (see FIG. 4).

The button 40 moves back by the rebounding force of the first elastic member 50 when the external force has ceased. The rotating block 61 is pushed by the protrusion 421 and can disengage from the spring tab 411 and continues to rotate. When the button 40 moves to an engaging position (see FIG. 5), the end of the protrusion 421 is received in the recess 611 of the rotating block 61. The point of the end of the protrusion 421 contacting the recess 611 is P. In the embodiment, the recess 611 of the rotating block 61 is V-shaped. The distance S between the point P and the rotating axis of the rotating block 61 is more than the distance D between the rotating axis of the rotating block 61 and the end of the protrusion 421. The protrusion 421 can thus not disengage from the recess 611. The button 40 thus stays in the secondary position, which thus causes a movable contact (not shown) to engage a stationary contact (not shown). The push switch 10 thus changes from an electrically open state to an electrically closed state.

Figure 6:
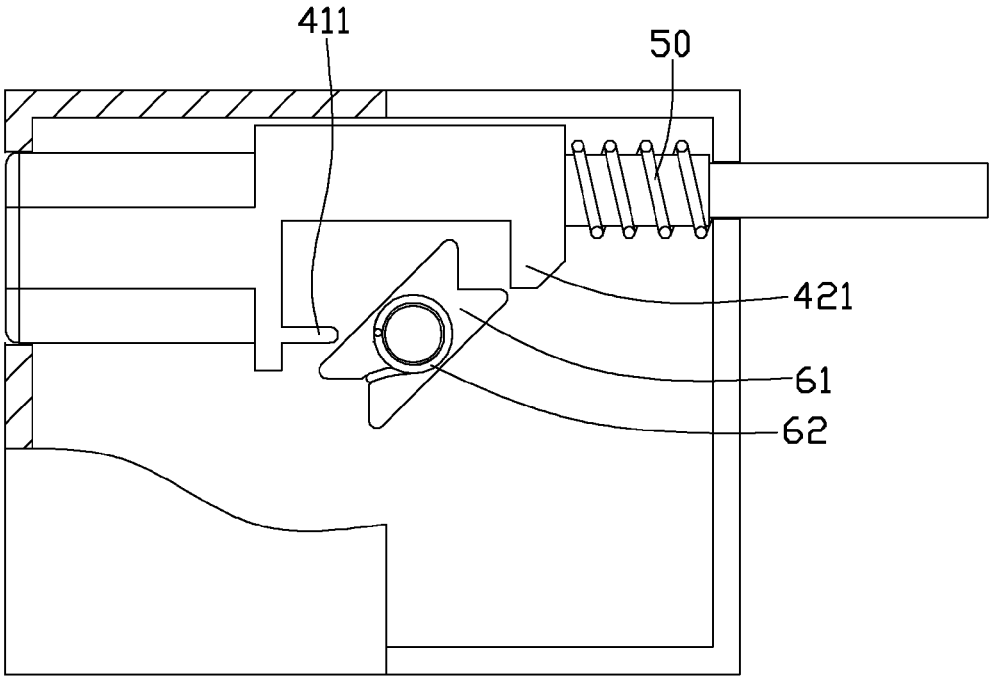
FIG. 6 is similar to FIG. 2, showing a state of the push switch when the button is further depressed.
Figure 7:
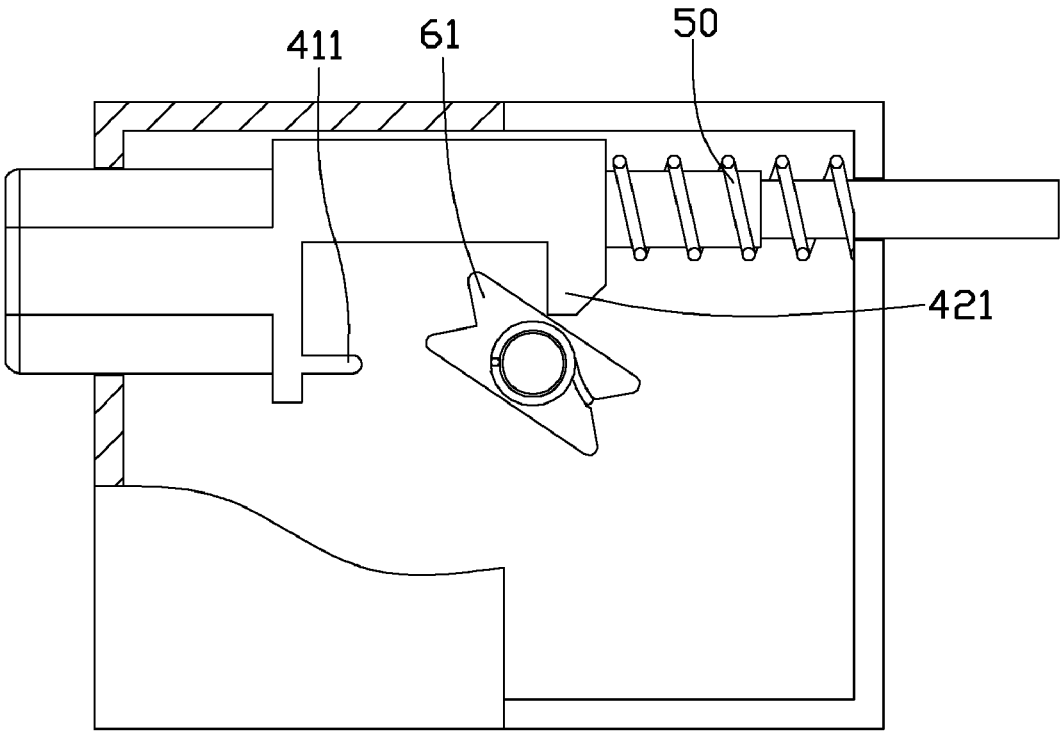
FIG. 7 is similar to FIG. 2, showing a state of the push switch that the button and the rotating block is returning to the initial state.

Referring to FIGS. 6-7, once being pushed again, the button 40 moves inward. The protrusion 421 of the connecting member 42 then disengages from the rotating block 61. The rotating block 61 can thus rotate back to the initial position by the rebounding force of the second elastic member 62. After the external force on the button 40 has ceased, the button 40 rebounds to its initial position by the driving of the first elastic member 50. The push switch 10 thus returns to the electrically open state.

Although the present disclosure has been specifically described on the basis of the exemplary embodiment thereof, the disclosure is not to be construed as being limited thereto.

Various changes or modifications may be made to the embodiment without departing from the scope and spirit of the disclosure.

What is claimed is:

1. A push switch comprising:

a housing;

a button slidably connected to the housing and comprising a protrusion protruding therefrom;

a first elastic member positioned between the housing and the button to apply a rebounding force to the button; and a securing member comprising a rotating block and a second elastic member, the rotating block rotatably connected to the housing and arranged on one side of the protrusion, one end of the rotating block defining a recess, the second elastic member being connected to the housing and the rotating block to apply a rebounding force to the rotating block;

wherein the protrusion drives the rotating block to rotate when the button is pushed by an external force, the first elastic member is compressed, and the second elastic member is deformed; after the external force has ceased, the button starts to move back by the rebounding force of the first elastic member, the rotating block moves back by the rebounding force of the second elastic member, the button keeps in the predetermined position when the button moves such that the protrusion is retained in the recess;

the protrusion of the button disengages from the rotating block when the button is driven again by the external force, after the external force has ceased, the rotating block rotates to an initial position by the rebounding force of the second elastic member, the button moves back to its initial position by the rebounding force of the first elastic member.

2. The push switch as described in claim 1, wherein the first elastic member is a coil spring.

3. The push switch as described in claim 1, wherein the button comprises a pushing member, a connecting member and a guiding member, the connecting member connects the guiding member to the pushing member, the first elastic member is arranged around the guiding member.

4. The push switch as described in claim 3, wherein the housing comprises a top and a bottom, the second elastic member is a torsion spring, one end of the torsion spring is fixed to the top, an opposite end of the torsion spring is fixed to the bottom, and the torsion spring is connected to the rotating block.

5. The push switch as described in claim 4, wherein the housing further comprises a sidewall defining two opposite through holes, the pushing member extends through one of the through hole and is external to the housing, the guiding member extends through the other through hole.

6. The push switch as described in claim 3, wherein a spring tab protrudes from one end of the pushing member, the spring tab is configured to contact the rotating block to stay the rotating block static.

7. The push switch as described in claim 1, wherein the recess is V-shaped.

8. The push switch as described in claim 1, wherein the distance S between a point P and the rotating axis of the rotating block is more than the distance D between the rotating axis of the rotating block and the end of the protrusion, the point P is the point of the end of the protrusion contacting the recess.

* * * * *